US007152257B2

(12) United States Patent
Stratmann et al.

(10) Patent No.: US 7,152,257 B2
(45) Date of Patent: Dec. 26, 2006

(54) TOILET CONSTRUCTION

(75) Inventors: Michael Stratmann, deceased, late of Kleinmachnow (DE); by Hartmut Lasch, legal representative, Karlsruhe (DE); Walter Hardt, Kleinmachnow (DE)

(73) Assignee: Wall Aktiengesellschaft, Berlin (DE)

( * ) Notice: Subject to any disclaimer, the term of this patent is extended or adjusted under 35 U.S.C. 154(b) by 318 days.

(21) Appl. No.: 10/502,452

(22) PCT Filed: Jan. 23, 2003

(86) PCT No.: PCT/EP03/00664

§ 371 (c)(1),
(2), (4) Date: Jul. 26, 2004

(87) PCT Pub. No.: WO03/064790

PCT Pub. Date: Aug. 7, 2003

(65) Prior Publication Data

US 2005/0125891 A1 Jun. 16, 2005

(30) Foreign Application Priority Data

Feb. 1, 2002 (DE) ..... 102 04 343

(51) Int. Cl.
*A47K 17/00* (2006.01)

(52) U.S. Cl. ..... 4/661; 52/34; 52/64

(58) Field of Classification Search ..... 4/449, 4/661, 664; 52/34, 64, 79.1
See application file for complete search history.

(56) References Cited

U.S. PATENT DOCUMENTS 3,813,836 A * 6/1974 Dielman ..... 52/239

FOREIGN PATENT DOCUMENTS

| | | |
|---|---|---|
| DE | 1 248 903 | 8/1967 |
| DE | 36 18 482 | 12/1986 |
| DE | 36 07 365 | 9/1987 |
| DE | 93 17 636 | 3/1994 |
| DE | 43 18 618 | 12/1994 |
| DE | 94 09 437 | 12/1994 |
| DE | 196 51 451 | 5/1997 |
| DE | 196 49 024 | 5/1998 |
| DE | 100 37 758 | 5/2001 |
| JP | 03 202 562 | 9/1991 |
| JP | 05 163 758 | 6/1993 |
| JP | 2001 098 773 | 4/2001 |

* cited by examiner

*Primary Examiner*—Charles E. Phillips
(74) *Attorney, Agent, or Firm*—Paul Vincent

(57) ABSTRACT

The invention relates to a toilet construction comprising at least two adjacent toilet cubicles which respectively have a toilet and an access opening which can be closed by means of a door, said toilet cubicles being separated by means of a partition. According to the invention, the partition can be displaced between a separating position in which it separates the toilet cubicles from each other, and an unblocking position in which the two toilet cubicles together form an individual toilet cubicle. Alternatively, the partition can be displaced essentially perpendicularly to its wall plane in a shifted position in which the floor space of one toilet cubicle is enlarged and the floor space of the other toilet cubicle is reduced.

16 Claims, 10 Drawing Sheets

TOILET CONSTRUCTION

This application is the national stage of PCT/EP03/00664 filed on Jan. 23, 2003 and also claims Paris Convention priority of DE 102 04 343.4 filed Feb. 01, 2002.

BACKGROUND OF THE INVENTION

The invention concerns a toilet structure comprising at least two adjacent toilet cubicles each of which has a toilet and an access opening which can be closed by means of a door, the toilet cubicles being separated by a separating wall.

Toilet structures of this type comprising several toilet cubicles are provided, in particular, at locations, where a relatively large number of people want to use a toilet, such as e.g. in public buildings, restaurants, train stations, airports, at events etc. To utilize the available space to the maximum and provide a large number of toilet cubicles, the individual toilet cubicles usually have a relatively small base area which is sufficient for non-handicapped people. However, people in wheel-chairs usually cannot move into a toilet cubicle to use the toilet. For this reason, an additional toilet space adapted for handicapped people in wheel-chairs is provided as an individual, spatially separated facility which is experienced by many people in wheel-chairs as segregation and stigmatisation. A toilet space suited for handicapped people requires a relatively large base area, since the person in the wheel-chair must be able to easily move with his/her wheel-chair in front of the toilet and optionally put the wheel-chair either on the right-hand or left-hand side next to the toilet to be able to move from the wheel-chair onto the toilet. Due to the large space requirements, the integration of a toilet space suited for handicapped people is often undesired in a conventional toilet structure since it reduces the number of toilet cubicles. Moreover, space is not efficiently utilized, since toilets for handicapped people are not frequently used.

It is the underlying purpose of the invention to provide a toilet structure of the above-mentioned type which has an integrated toilet space suited for handicapped people while also providing effective utilization of space.

SUMMARY OF THE INVENTION

This object is achieved in a first inventive design of the toilet structure in that the separating wall can be adjusted between a separating position, in which the toilet cubicles are separated, and a release position in which the two toilet cubicles combine to form one single toilet space.

The invention is based on the fundamental idea of providing the toilet space for handicapped people not as a separate facility, but to combine two normal toilet cubicles into a large toilet space which is suited for handicapped people, if required, by adjusting, displacing or removing the separating wall dividing the toilet cubicles. As long as the separating wall is in its separating position, the toilet cubicles can be used in the conventional manner. If a person in a wheel-chair wants to use a toilet, he/she can adjust the separating wall between the two toilet cubicles using an actuating means which is preferably provided on the outside of the toilet cubicles. Initiation of the adjusting motion is preceded by checking whether or not both toilet cubicles are free. After adjustment of the separating wall, the person in the wheel-chair has one single toilet space which has the total base area of both toilet cubicles and includes the two toilets. The toilets are thereby disposed such that the person in the wheel-chair can easily move to the right next to one toilet or to the left next to the other toilet. In this manner, the person in the wheel-chair can select the toilet to which he/she wants to move towards the right or left out of his/her wheel-chair in a convenient manner. As soon as the person in the wheel-chair has left the toilet, the separation wall returns, preferably automatically, into its separating position to once more provide two independent toilet cubicles to be used by non-handicapped persons.

To permit entry of the person in a wheel-chair into the toilet space, both access openings of the two adjacent toilet cubicles are preferably disposed directly next to each other and are separated only by the separating wall. If the separating wall is in its release position, the two access openings combine to form one single enlarged access opening having twice the width, which facilitates entry of the person in a wheel-chair into the toilet cubicle.

The separating wall may be adjusted in many ways. In one possible design of the invention, the separating wall is formed from several vertical, adjacent wall elements which can each be pivoted about a vertical axis. The wall elements may thereby be interconnected in a hinged manner to form a folding wall. When the separating wall is adjusted from the separated position into the release position, the individual wall elements are pivoted relative to each other such that they are stacked against each other.

To prevent the stack formed by the wall elements from obstructing the toilet space in the release position of the separating wall, the stack should abut a side wall of the toilet space in the release position or be accommodated in a gap of the toilet space. The gap may be covered by an automatically closing door to prevent manipulation of the mechanical adjusting structure of the separating wall.

In an alternative design, the separating wall may be formed from several horizontal, superposed wall elements which can each be pivoted about a horizontal axis. The wall elements may thereby be interconnected in a hinged manner to form a vertically opening folding wall, and are preferably stacked on top each other in the release position of the separating wall. In a particularly preferred manner, the wall elements are disposed in the ceiling region of the toilet space in the release position of the separating wall, where they do not obstruct motion of the person in a wheel-chair in the toilet space. Instead of a vertically opening folding wall, the wall may be configured as a vertically opening and closing rolling door comprising a plurality of horizontal panels which can be wound about a winding axis disposed in the ceiling region of the toilet space. To ensure that the separating wall has sufficient stability in its separated position, the superposed wall elements or panels should engage each other in the separating position of the separating wall thereby preventing mutual displacement of the wall elements perpendicular to the plane of the wall.

In a further design of the invention, the entire separating wall may be displaceable substantially in the plane of the wall and through a side wall of the toilet cubicles or the toilet space into a position outside of the toilet space. The separating wall may thereby be designed as a one-piece plate. Since the separating wall need not be subdivided into different wall elements, this design advantageously has increased stability. Arrangement of the separating wall outside of the toilet space requires, however, corresponding space at that location.

The separating wall may alternatively be formed from a plurality of adjacent vertical panels which can be pivoted relative to each other and deflected through approximately 90° at the outer side of the toilet space such that the separating wall requires only little space outside of the toilet space when it is in its release position.

In a further development of the invention, the separating wall may be formed from a plurality of adjacent vertical panels which can be wound about a vertical winding mandrel at the outer side of the toilet space. In this case, the separating wall has the design of a vertically disposed opening and closing rolling door having vertical panels.

The above-mentioned designs are based on the fundamental idea of forming a toilet space, which is suited for handicapped persons, from the two adjacent toilet cubicles after adjustment of the separating wall. In an alternative design of the invention, the above-mentioned object is also achieved in that the separating wall can be adjusted substantially perpendicularly to the plane of the wall into a displaced position in which the base area of the one toilet cubicle is enlarged and the base area of the other toilet cubicle is reduced. The toilet space thereby has the base area of a toilet cubicle and additionally of part of the base area of the other toilet cubicle, since the separating wall between the two toilet cubicles is not removed but only laterally displaced.

If the individual toilet cubicles are large enough, the lateral displacement of the separating wall may produce a toilet space suited for handicapped people which meets the corresponding space requirements.

The toilets in the toilet space formed through lateral displacement of the separating wall may be disposed such that there is sufficient space on both sides of the toilet for a person in a wheel-chair to optionally position his/her wheel-chair either on the right or left-hand side of the toilet. Toilet cubicles do not usually provide such a space. In a further development of the invention, the separating wall can therefore be optionally adjusted in opposite directions. The person in a wheel-chair can thereby either optionally extend one toilet cubicle through displacement of the separating wall towards the toilet space or displace the separating wall in the opposite direction such that the other toilet cubicle is extended into the toilet space through corresponding actuation of the actuating means disposed outside of the toilet cubicles. The toilets are disposed in the toilet cubicles such that there is enough space for a wheel-chair on the right-hand side of the one toilet and on the left-hand side of the other toilet. The person in a wheel-chair can decide through selection of the adjusting means of the separating wall whether he/she wants to use a toilet space where he/she can move from the right-hand or left-hand side out of the wheel-chair and onto the toilet.

This design of a toilet structure may also envision the access openings of the toilet cubicles to be directly adjacent to each other and together form one single enlarged access opening when the separating wall has been displaced. This facilitates access to the toilet space for a person in a wheel-chair. In this position, the toilet cubicle which was reduced in size through displacement of the separating wall is no longer accessible, since its access opening is part of the enlarged access opening of the toilet space.

BRIEF DESCRIPTION OF THE DRAWING

Further details and features of the invention can be extracted from the following description of an embodiment with reference to the drawing.

DESCRIPTION OF THE PREFERRED EMBODIMENT

Figure 1:
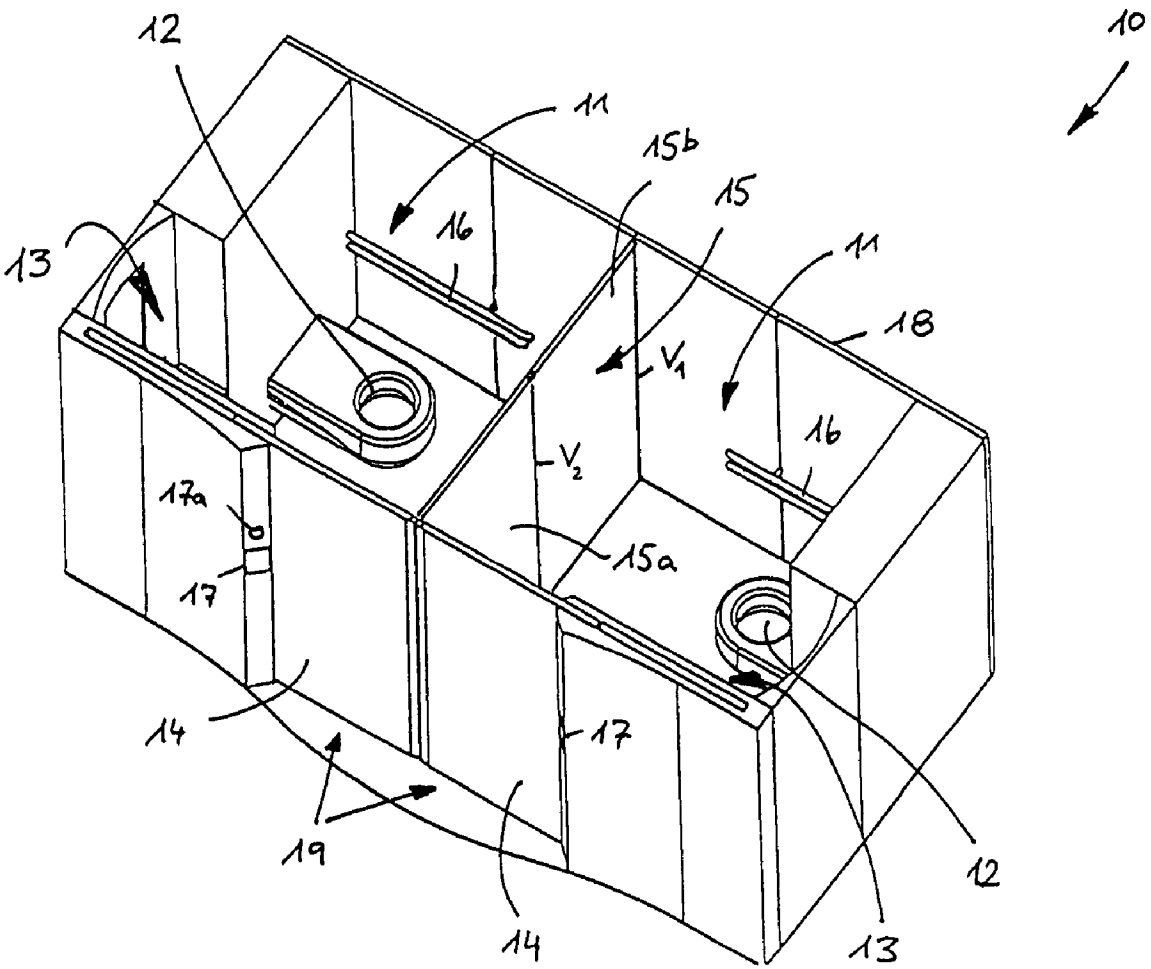
FIG. 1 shows a perspective view of an inventive toilet structure, wherein the separating wall is in its separating position.
Figure 2:
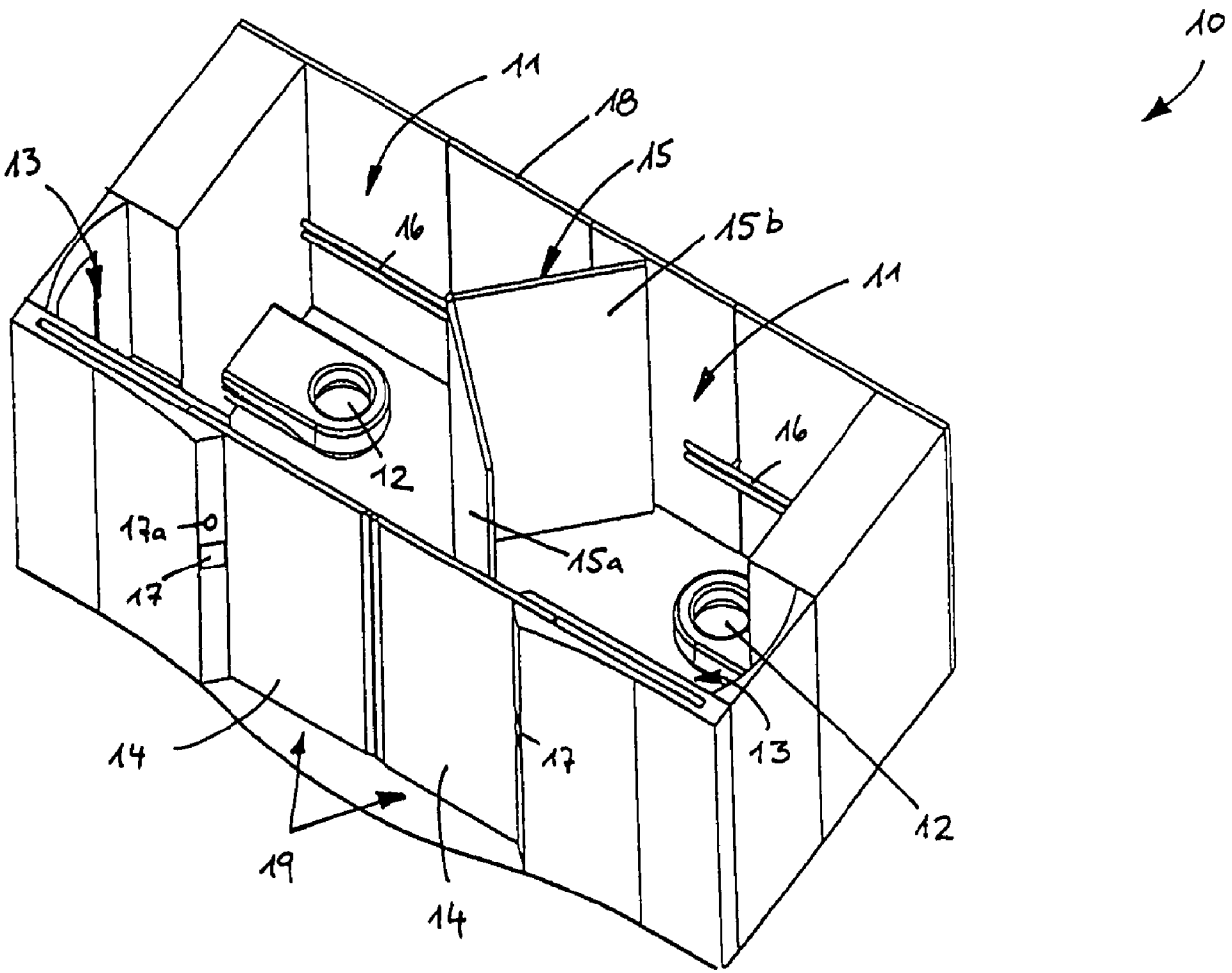
FIG. 2 shows the toilet structure in accordance with FIG. 1 during adjustment of the separating wall.
Figure 3:
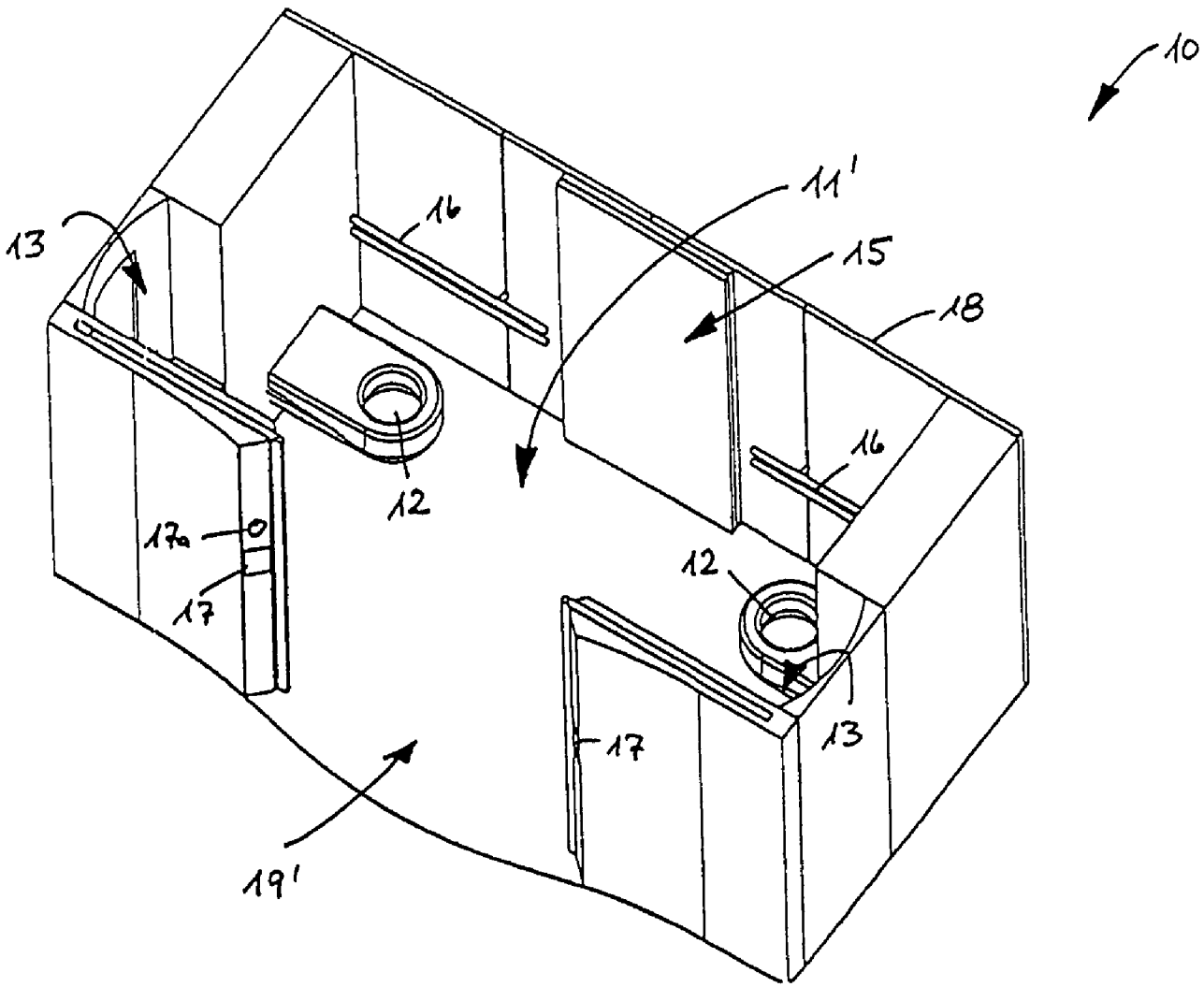
FIG. 3 shows the toilet structure in accordance with FIG. 1 wherein the separating wall is in its release position.

FIGS. 1, 2 and 3 show perspective views of a toilet structure 10 comprising two adjacent toilet cubicles 11. Each toilet cubicle 11 has a toilet 12 with an associated lateral foldable handle 16. A washing means 13 (not shown in detail) with a wash basin, hand dryer, mirror and soap dispenser is provided in a gap of each toilet cubicle 11. The two toilet cubicles 11 are separated by a separating wall 15 and each have an access opening 19 which can be closed by a door 14 which is in the present embodiment a sliding door. The access openings 19 of the two toilet cubicles 11 are directly adjacent and are subdivided only by the separating wall 15.

The toilet 12 of the left-hand toilet cubicle 11 of FIG. 1 is disposed on the side wall opposite to the separating wall 15 such that there is sufficient space on the right-hand side in front of the washing means 13 for a user sitting on the toilet 12 to place a wheel-chair. In the toilet cubicle 11 on the right-hand side of FIG. 1, the toilet 12 is also disposed on the side wall opposite to the central separating wall 15 such that there is sufficient space on the left-hand side in front of the washing means 13 for a user sitting on the toilet 12 to place a wheel-chair.

The separating wall 15 in the embodiment shown is formed from two vertical adjacent wall elements 15*a* and 15*b*. The wall element 15*a* abuts the doors 14 on its side facing the access openings 19 and is connected, on its opposite side disposed substantially in the center of the separating wall 15 and in a hinged manner about a vertical axis $V_2$, to the other wall element 15*b* which is disposed, on its opposite side, in a hinged manner about a vertical axis $V_1$ to be displaced towards the common rear wall 18 of the toilet cubicles 11 thereby constituting a folding wall made from two wall elements 15*a*, 15*b*.

A display 17 is disposed on each outer side of the toilet cubicles 11 which indicates to a person located outside whether the respective toilet cubicle 11 is occupied or free. At least one of the displays 17 has an associated actuating means 17*a*. A person in a wheel-chair can displace, by means of the actuating means 17*a*, the separating wall 15 from the separating position of FIG. 1 in which the two toilet cubicles 11 are separated, into a release position of FIG. 3 in which the two wall elements 15*a* and 15*b* lie against each other over their entire surface and abut the rear wall 18 in the region between the holders 16. During adjustment about the vertical axis $V_2$, the wall element 15*a* is pivoted relative to the wall element 15*b* which is pivoted about the vertical axis $V_1$ at the rear wall 18 and at the same time is laterally displaced along the rear wall 18 (FIGS. 1, 2 and 3). In the release position of the separating wall 15 of FIG. 3, one single toilet space 11' is formed which comprises the base area of the two toilet cubicles 11 and has one single enlarged access opening 19' which is formed from a combination of the two adjacent access openings 19 of the toilet cubicles. A person in a wheel-chair can easily enter through the enlarged access opening 19' into the toilet space 11' and can chose from two differently arranged toilets 12 next to which the wheel-chair can be disposed. If he/she disposes his/her wheel-chair next to the left-hand toilet 12 of FIG. 3, he/she can move from the wheel-chair to the left and onto the toilet 12, whereas if he/she disposes the wheel-chair next to the toilet 12 on the right-hand side of FIG. 3, he/she can move to the right and onto the toilet 12.

After use by a person in a wheel-chair, the separating wall returns from its release position of FIG. 3 into its separating position of FIG. 1 to once more permit further use of the two toilet cubicles 11 independently of each other in the conventional manner.

Figure 4:
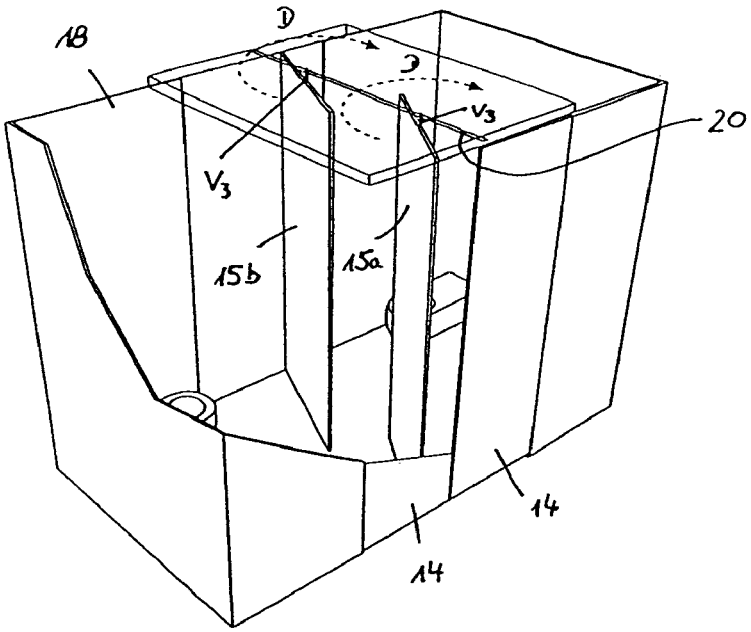
FIG. 4 shows a perspective view of a toilet structure with one first alternative design of the separating wall.

In the embodiment of FIGS. 1 through 3, the separating wall is designed as two-part folding wall with vertical folding or pivot axes. FIG. 4 shows a modification of the separating wall 15 which also has two wall elements 15*a*, 15*b*, which can each be pivoted independently of each other about a vertical longitudinal central axis $V_3$ and are located in an upper guidance 20. To adjust the separating wall 15 from its separating position into the release position, the two wall elements 15*a* and 15*b* are each pivoted through 90° about their vertical longitudinal central axis $V_3$ in correspondence with arrows D and are then displaced along the guidance 20 against the rear wall 18 of the toilet structure such that they mutually abut with their full surface on the rear wall 18 in the release position thereby enlarging the toilet space 11' as mentioned above.

Figure 5:
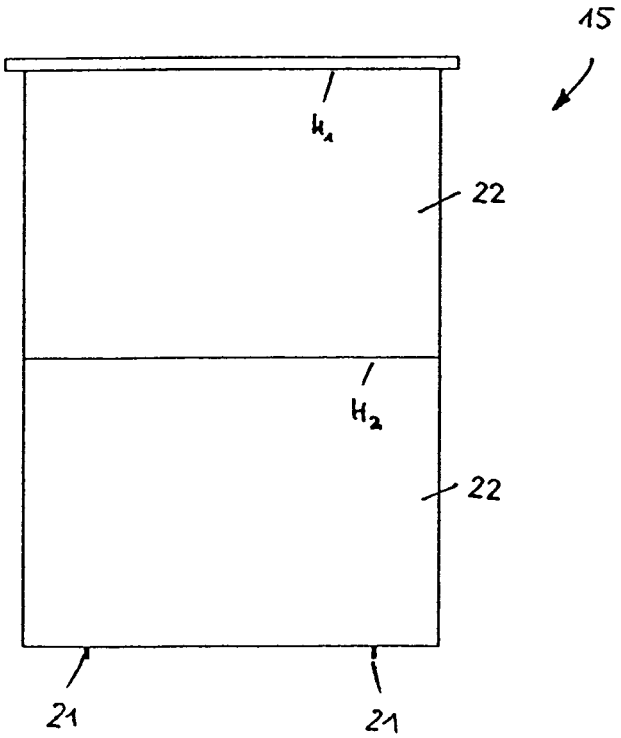
FIG. 5 shows a view of a second alternative design of the separating wall.

FIG. 5 shows an alternative design of the separating wall 15 which is formed from two superposed wall elements 22, wherein the lower wall element 22 has engagement pins 21 on its lower side which engage in recesses of the floor of the toilet structure in the separating position of the separating wall. The upper side of the lower wall element 22 is connected to the upper wall element 22 to be pivotable about a horizontal axis $H_2$, the upper wall element being mounted with its upper side to the ceiling of the toilet structure to be pivotable about a horizontal axis $H_1$ thereby forming a folding wall with horizontal folding or pivot axes which can be opened and closed in a vertical direction.

Figure 6A:
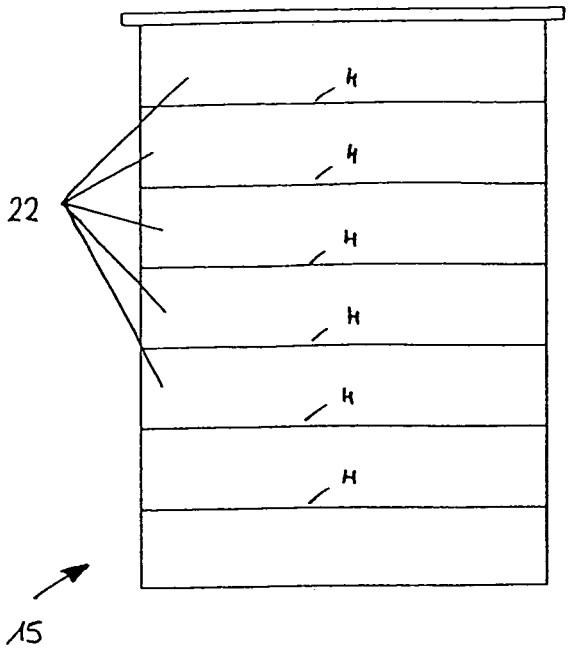
FIG. 6*a* shows a view of a third alternative design of the separating wall.
Figure 6B:
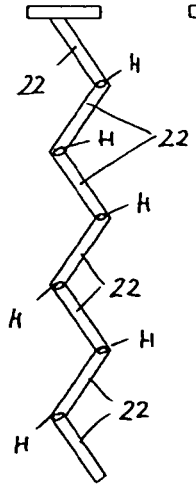
FIG. 6*b* shows a side view of the separating wall in accordance with FIG. 6*a* during adjustment.
Figure 6C:
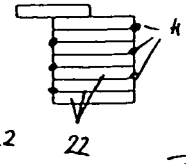
FIG. 6*c* shows the separating wall in accordance with FIG. 6*a* in the release position.

Although the folding wall of FIG. 5 consists of only two wall elements 22, a plurality of wall elements may also be used. FIG. 6*a* shows a separating wall 15 which consists of seven superposed wall elements 22 which extend in a transverse direction and are all interconnected in a hinged manner for pivoting about a horizontal axis H. The wall elements 22 may be lifted and thereby mutually pivoted (FIG. 6*b*) such that they form a stack in the release position (FIG. 6*c*) which is held at the ceiling of the toilet structure. The stack of wall elements 22 does not obstruct movement of the person in a wheel-chair within the toilet space 11' since it projects only slightly downwardly from the ceiling.

Figure 7:
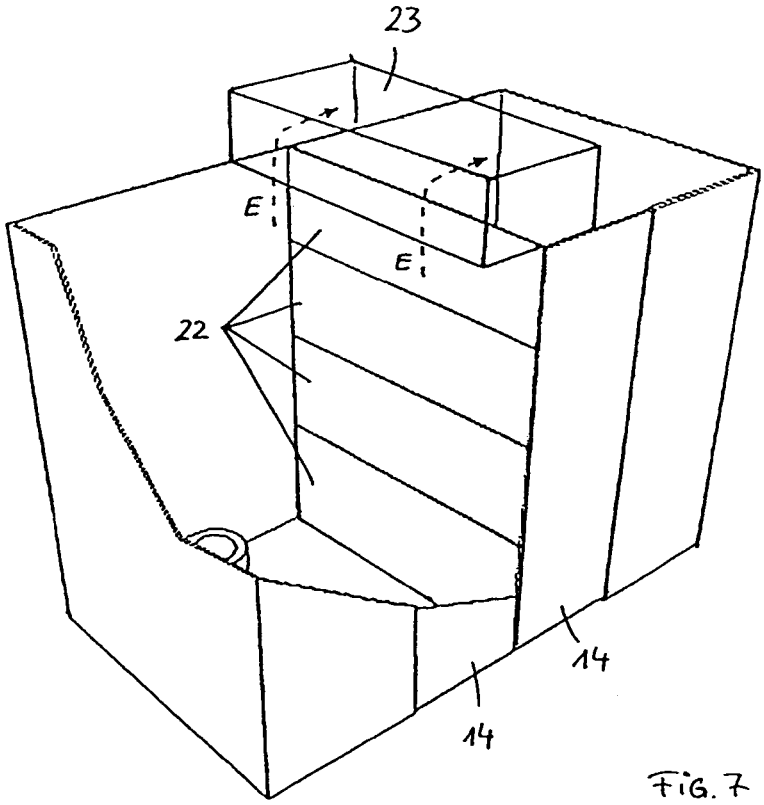
FIG. 7 shows a perspective view of a toilet structure with a fourth alternative design of the separating wall.

To prevent the stack formed by the wall elements 22 from protruding downwardly from the ceiling of the toilet structure, a storage box 23 may be disposed on the toilet structure into which the wall elements 22 are lifted, deflected by 90°, and laterally inserted, as indicated by arrows E in FIG. 7.

Figures 8A, 8B:
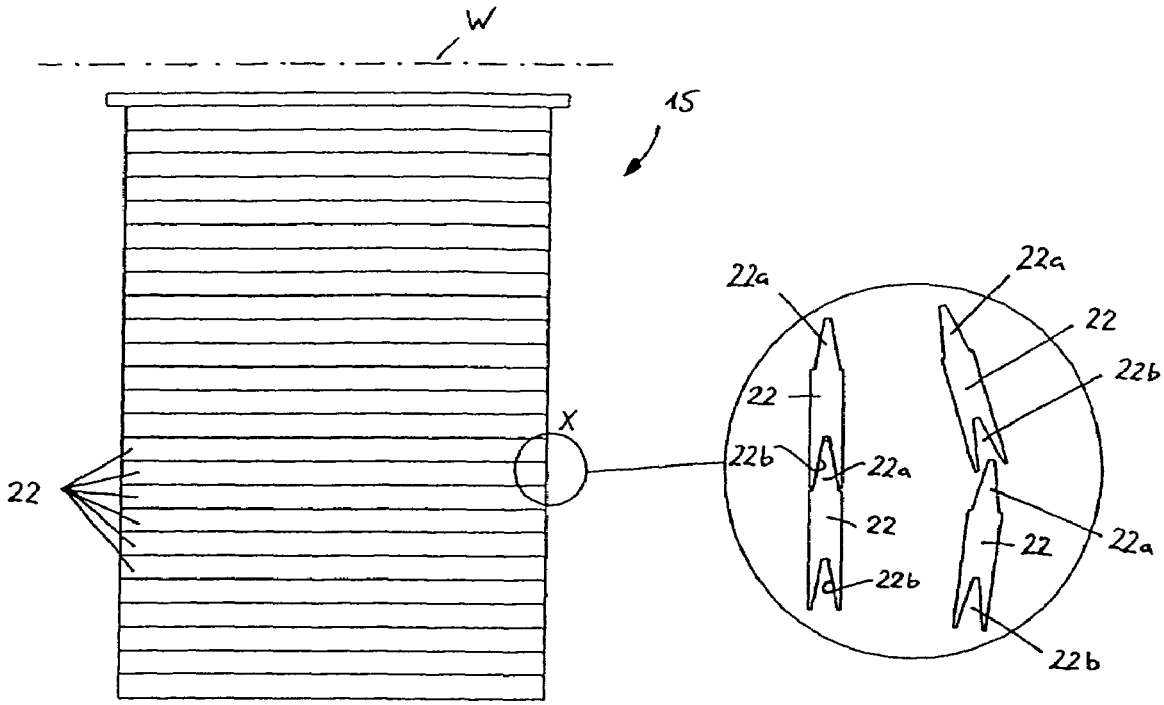
FIG. 8*a* shows a view of the separating wall in accordance with a fifth alternative design.
FIG. 8*b* shows the detail X of FIG. 8*a;*
Figure 9A:
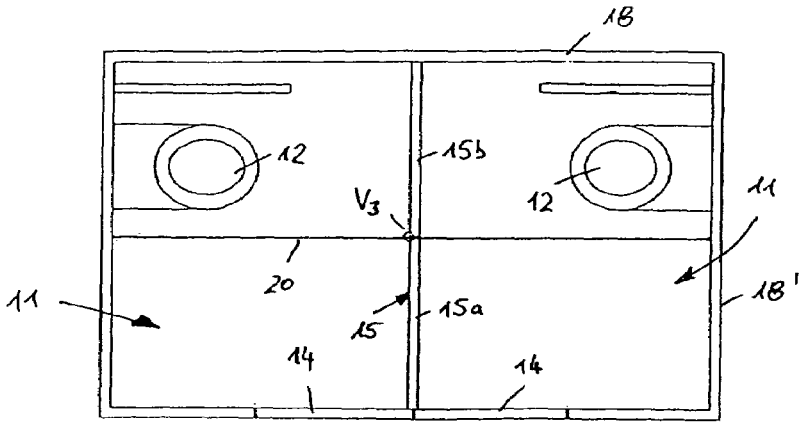
FIG. 9*a* shows a plan view of a toilet structure in accordance with a sixth alternative design of the separating wall which is in its separating position.
Figure 9B:
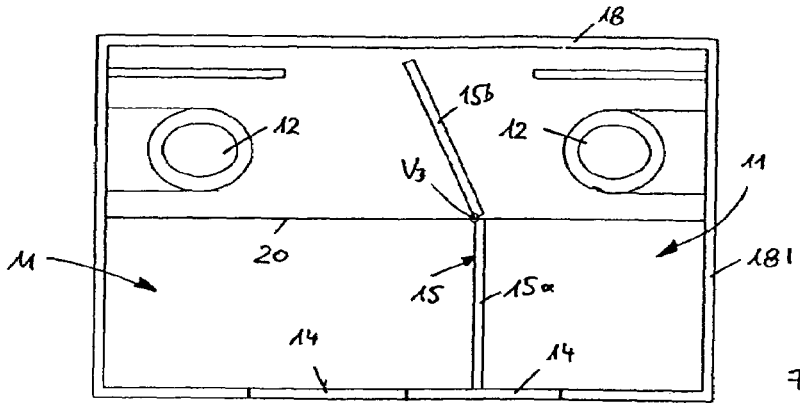
FIG. 9*b* shows the toilet structure in accordance with FIG. 9*a* in a first phase of adjustment of the separating wall.
Figure 9C:
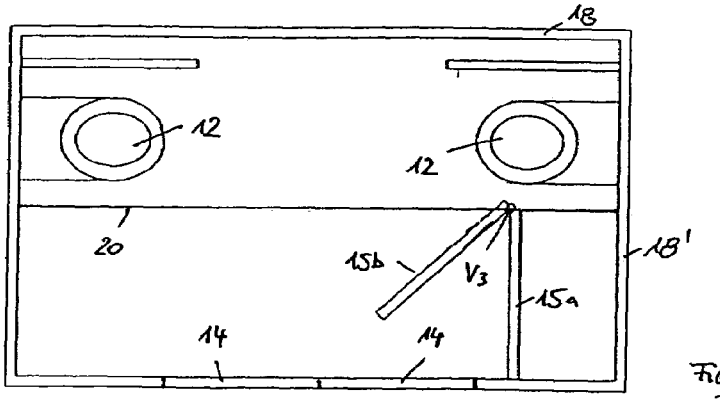
FIG. 9*c* shows the toilet structure in accordance with FIGS. 9*a* and 9*b* in a second phase of adjustment of the separating wall.
Figure 9D:
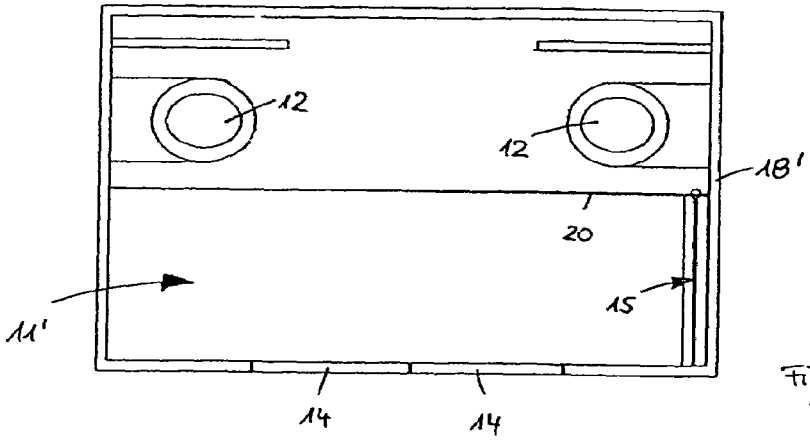
FIG. 9*d* shows the toilet structure in accordance with FIGS. 9*a*, 9*b* and 9*c* in the release position of the separating wall.

FIGS. 8*a* and 8*b* show a separating wall 15 in the form of a rolling door which consists of a plurality of horizontal strip-shaped wall elements 22 which are interconnected in a hinged manner and which can be wound in a conventional manner onto an upper winding axis W (only schematically indicated). The wall elements 22 can be slightly adjusted relative to each other in a vertical direction. In this manner, it is possible that an upwardly protruding projection 22*a* of a wall element 22 positively engages in a complementary lower recess 22*b* of the wall element 22 disposed on top thereof (FIG. 8*b*, left-hand illustration) thereby improving the stability of the separating wall 15 in the separating position. If the wall elements 22 are lifted relative to each other when the separating wall is adjusted, they are released from their mutual engagement as shown on the right-hand side of FIG. 8*b* which facilitates winding up thereof.

FIGS. 9*a* through 9*d* show a design of the separating wall 15, wherein it does not abut the rear wall 18 of the toilet structure but the side wall of one of the toilet cubicles 11 in its release position. The separating wall 15 is thereby also formed from two vertical adjacent wall elements 15*a* and 15*b*. The wall element 15*a* facing the access openings 19 can be displaced perpendicularly to its wall plane along a guidance 20 and its end disposed in the center of the toilet structure carries the wall element 15*b* which can be pivoted relative to the wall element 15*a* about a vertical axis $V_3$. During adjustment of the separating wall from the separating position of FIG. 9*a*, the wall element 15*a* is displaced perpendicularly to its wall plane in a transverse direction of the toilet structure thereby simultaneously pivoting the wall element 15*b* about the vertical axis $V_3$ until it is supported with its full surface on the wall element 15*a*. In their superposed state, the two wall elements 15*a* and 15*b* are stored next to the toilet 12 on the right-hand side of FIG. 9*d* such that they abut the side wall 18' and do not impair positioning of the wheel-chair next to the toilet 12. To return to the separating position, the wall element 15 is again displaced along the guidance into its initial position thereby simultaneously pivoting the wall element 15*b* about the vertical axis $V_3$ until it lies in a common plane with the wall element 15*a*.

Figure 10:
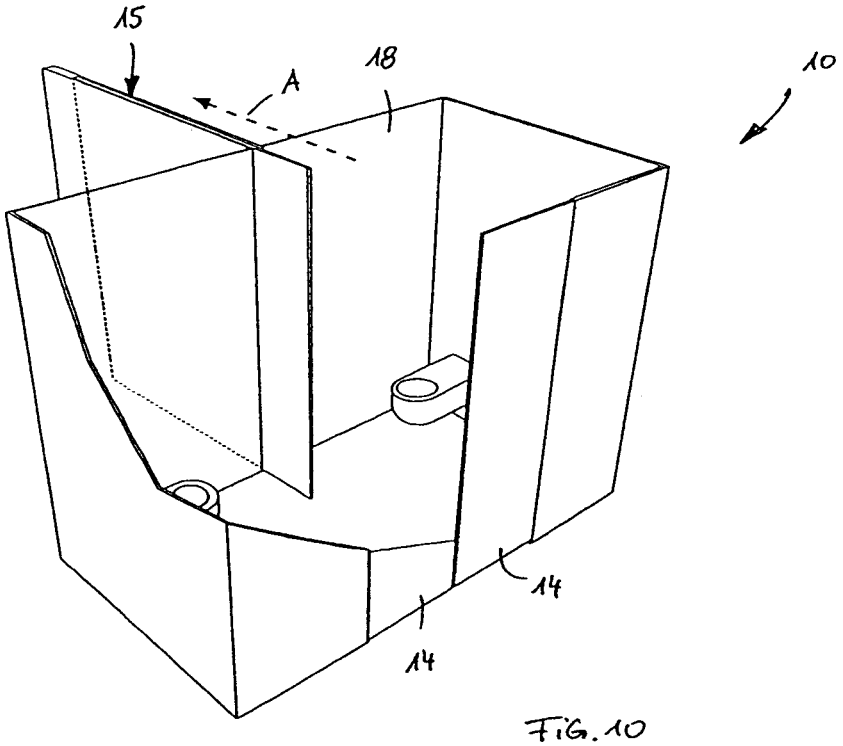
FIG. 10 shows a perspective view of a toilet structure in accordance with a seventh alternative design of the separating wall.

In the embodiments shown above, the separating wall was formed from several individual parts which can be pivoted relative to each other. FIG. 10 shows an embodiment in which the separating wall 15 is formed by one single wall element which can be displaced in the plane of the wall (indicated by arrow A). The separating wall 15 may be displaced towards the outside through a gap in the rear wall 18 of the toilet structure and out of the toilet space 11' such that, in the release position, it is disposed completely outside of the toilet cubicles or the toilet space. This ensures high stability of the separating wall 15 since it may be designed as a one-piece component but requires relatively large space outside of the toilet structure in its release position. This can be avoided in the design of FIG. 11, wherein the separating wall is formed from several panels 24 which are disposed about a vertical axis and can be pivoted relative to each other and are deflected through approximately 90° outside of the rear wall 18 using a deflecting device 23 such that, in its release position, the separating wall is disposed substantially parallel to the rear wall 18 of the toilet structure outside thereof.

Figure 11:
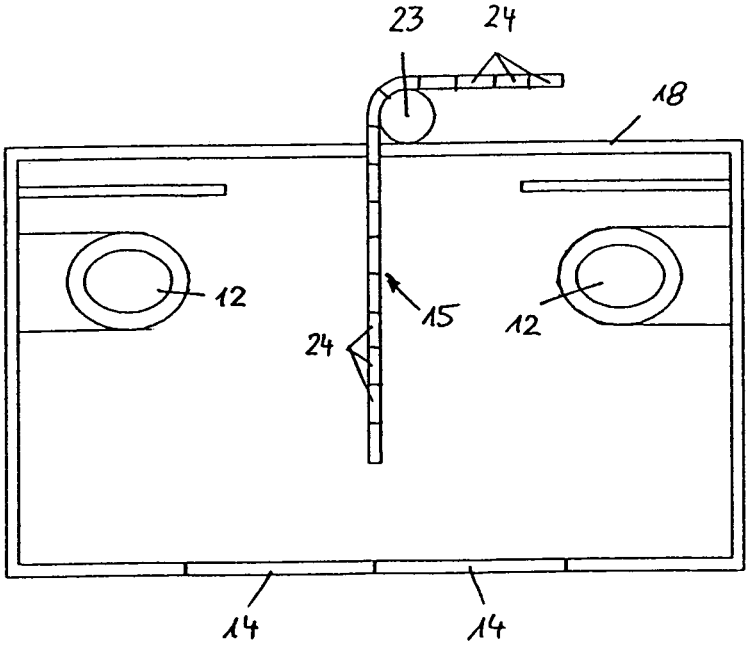
FIG. 11 shows a first modification of the toilet structure in accordance with FIG. 10.
Figure 12A:
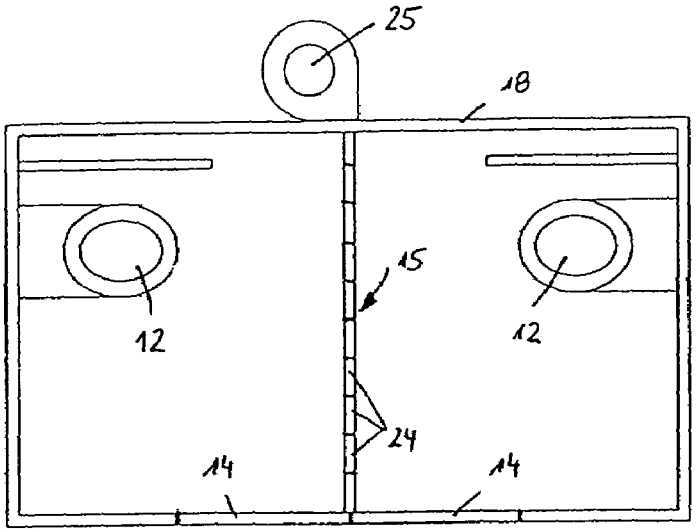
FIG. 12*a* shows a second modification of the toilet structure in accordance with FIG. 10 with the separating wall in the separating position.
Figure 12B:
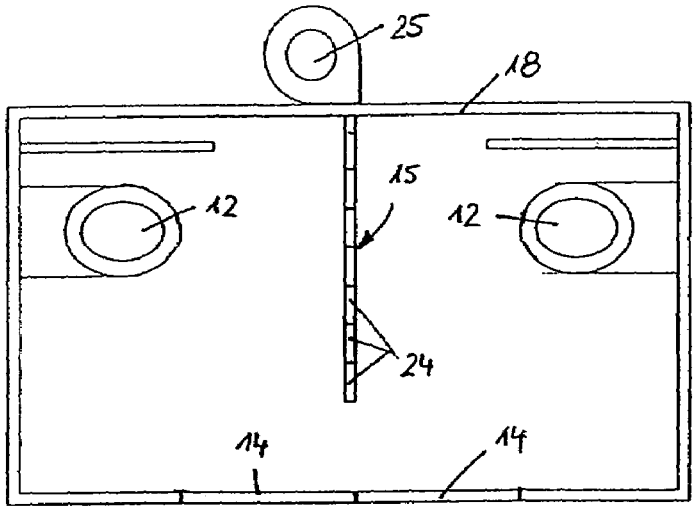
FIG. 12*b* shows the toilet structure in accordance with FIG. 12*a* during adjustment of the separating wall.
Figure 12C:
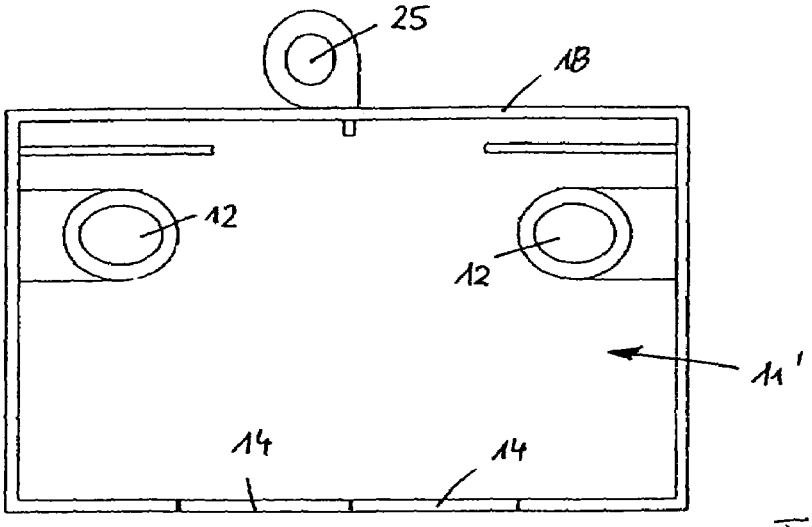
FIG. 12*c* shows the toilet structure in accordance with FIGS. 12*a* and 12*b* in the release position of the separating wall.

FIGS. 12*a*, 12*b* and 12*c* show a further development of the design of FIG. 11. The separating wall 15 formed from a plurality of vertical, adjacent panels 24 which can be pivoted relative to each other about a vertical axis, can be wound onto a winding mandrel 25 disposed outside of the toilet space 11' behind the rear wall 18, wherein the panels 24 are preferably in mutual engagement in the separating position of the separating wall of FIG. 12 as explained in connection with FIG. 8*b*.

Figure 13:
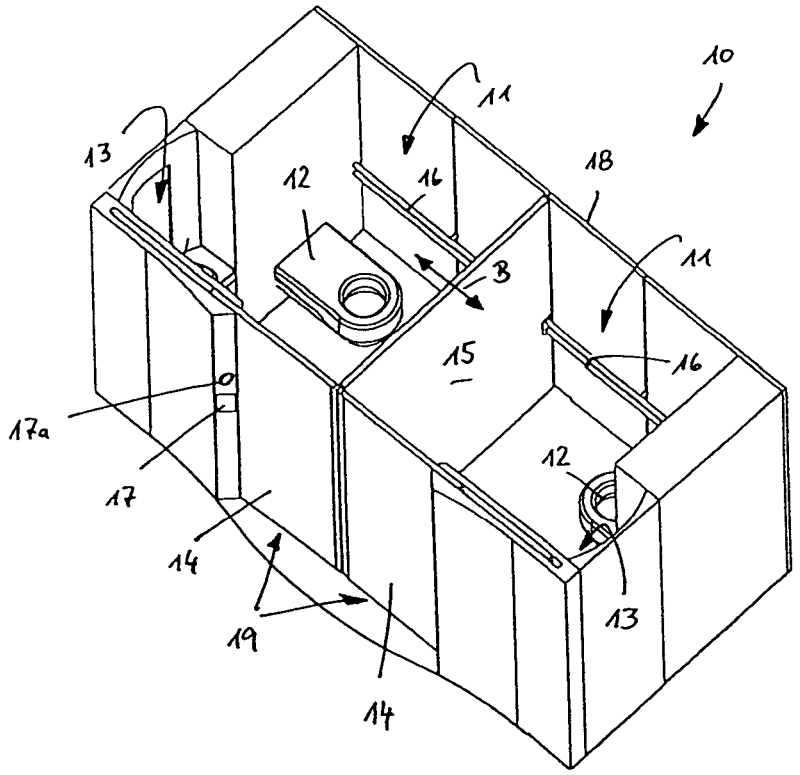
FIG. 13 shows a perspective view of an inventive toilet structure with displaceable separating wall in the separating position.
Figure 14:
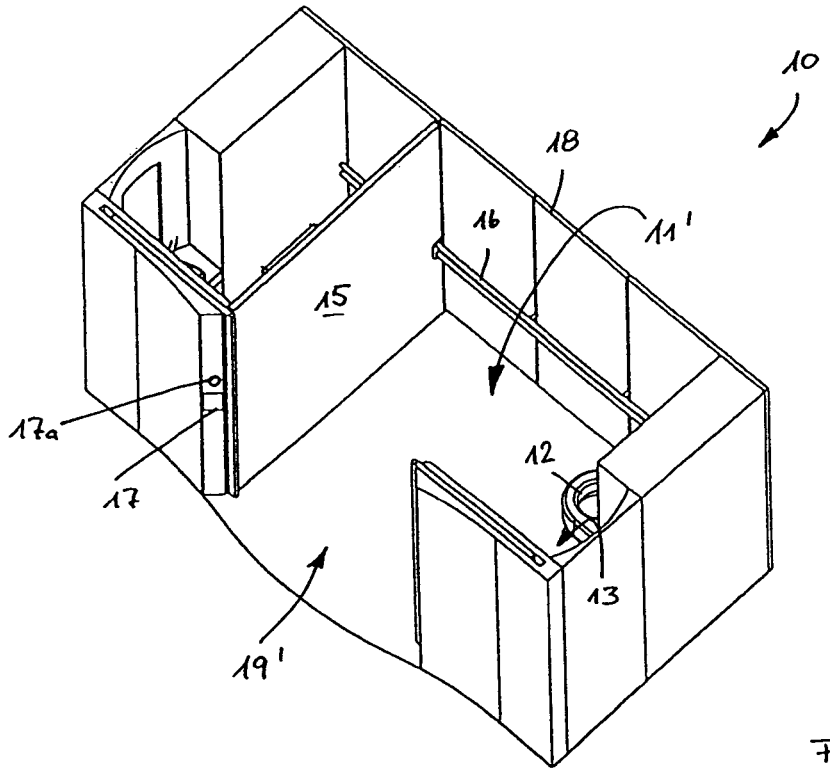
FIG. 14 shows the toilet structure in accordance with FIG. 13 with the separating wall in the release position.

While the embodiments shown above are based on the fundamental idea of adjusting the separating wall 15 such that the enlarged toilet space 11' is formed by the entire surface of the two toilet cubicles 11, FIGS. 13 and 14 show a different principle. In accordance with FIG. 13, the toilet structure has the construction as explained above in connection with FIG. 1, to which reference is hereby made, except for the separating wall 15. The separating wall 15 is designed as a one-piece wall which can be adjusted in both directions perpendicularly to its wall plane in accordance with the double arrow B.

FIG. 14 shows the end position of the separating wall 15 after displacement in the direction of the left-hand or upper toilet cubicle in accordance with FIG. 13. In the displaced position of the separating wall 15, the two access openings 19 combine into one single enlarged access opening 19' into a toilet space 11' which comprises the surface of the right-hand lower toilet cubicle 11 of FIG. 13 and approximately half of the base area of the left-hand upper toilet cubicle 11 of FIG. 13. The space of the left-hand upper toilet cubicle of FIG. 13 is reduced in size such that it can no longer be used, in particular since it no longer has an access opening. The toilet space 11' formed and enlarged through adjustment of the separating wall 15 in accordance with FIG. 14 has a toilet 12 onto which the person in a wheel-chair can move out of the wheel-chair to the right-hand side. If the person in the wheel-chair wants to move to the left-hand side out of his/her wheel-chair and onto the toilet, he/she must displace the separating wall 15 into the opposite direction before entering the toilet space 11' such that the toilet space 11' is formed by the left-hand upper toilet cubicle of FIG. 13 and part of the right-hand lower toilet cubicle. A toilet space 11' of this type includes an appropriately arranged toilet 12.

We claim:

1. A toilet structure comprising:

a first toilet cubicle having a first toilet, a first access opening, and a first door for closing said first access opening;

a second toilet cubicle adjacent to said first toilet cubicle, said second toilet cubicle having a second toilet, a second access opening, and a second door for closing said second access opening; and a separating wall disposed between said first toilet cubicle and said second toilet cubicle, said separating wall having a separation position in which said first toilet cubicle is separated from said second toilet cubicle, said separating wall also having a release position in which said first toilet cubicle and said second toilet cubicle are combined into one common toilet space, wherein said first access opening is directly adjacent to said second access opening, said first and said second access openings combining to form one enlarged common access opening in said release position of aid separating wall.

2. The toilet structure of claim 1, wherein said separating wall comprises several vertical, adjacent wall elements which can each be pivoted about a vertical axis.

3. The toilet structure of claim 2, wherein said wall elements are connected to each other in a hinged manner.

4. The toilet structure of claim 2, wherein said wall elements are stacked against each other in said release position.

5. The toilet structure of claim 2, wherein said wall elements abut a side wall of said common toilet space in said release position.

6. The toilet structure of claim 1, wherein said the separating wall is formed from several horizontal wall elements which are disposed on top of each other and can each be pivoted about a horizontal axis.

7. The toilet structure of claim 6, wherein said wall elements are connected to each other in a hinged manner.

8. The toilet structure of claim 6, wherein said wall elements are stacked against each other in said release position.

9. The toilet structure of claim 6, wherein said wall elements are disposed in a ceiling region of said common toilet space in said release position.

10. The toilet structure of claim 6, wherein adjacent wall elements are in mutual engagement in said separating position of said separating wall.

11. The toilet structure of claim 1, wherein said separating wall can be displaced in its entirety substantially in a plane of said separating wall.

12. The toilet structure of claim 11, wherein said separating wall is disposed outside of said common toilet space in said release position.

13. The toilet structure of claim 12, wherein said separating wall comprises a plurality of vertical, adjacent panels which can be deflected through approximately 90° at an outer side of said common toilet space.

14. The toilet structure of claim 12, wherein said separating wall comprises a plurality of vertical, adjacent panels which can be wound onto a winding mandrel at an outer side of said common toilet space.

15. A toilet structure comprising:

a first toilet cubicle having a first toilet, a first access opening, and a first door for closing said first access opening;

a second toilet cubicle adjacent to said first toilet cubicle, said second toilet cubicle having a second toilet, a second access opening, and a second door for closing said second access opening; and a separating wall disposed between said first toilet cubicle and said second toilet cubicle, said separating wall having a first position in which said first toilet cubicle is separated from said second toilet cubicle, said separating wall also having a second position displaced substantially perpendicularly to a plane of said separating wall in said first position such that said first toilet cubicle is enlarged and said second toilet cubicle is reduced in size, wherein said first access opening is directly adjacent to said second access opening, said first and said second access openings combining to form one enlarged common access opening in said second position of said separating wall.

16. The toilet structure of claim 15, wherein said separating wall can be displaced in opposite directions.

* * * * *